US009887493B2

(12) United States Patent
Lee

(10) Patent No.: US 9,887,493 B2
(45) Date of Patent: Feb. 6, 2018

(54) ELECTRIC PLUG

(71) Applicant: DONG SAN ELECTRONICS CO., LTD., Gimhae-si, Gyeongsangnam-do (KR)

(72) Inventor: Dae Ho Lee, Gimhae-si (KR)

(73) Assignee: DONG SAN ELECTRONICS CO., LTD., Gimhae-si (KR)

( * ) Notice: Subject to any disclaimer, the term of this patent is extended or adjusted under 35 U.S.C. 154(b) by 0 days.

(21) Appl. No.: 15/463,632

(22) Filed: Mar. 20, 2017

(65) Prior Publication Data

US 2017/0194743 A1 Jul. 6, 2017

Related U.S. Application Data

(63) Continuation of application No. PCT/KR2016/008136, filed on Jul. 26, 2016.

(30) Foreign Application Priority Data

Jul. 31, 2015 (KR) ..... 10-2015-0108439

(51) Int. Cl.
*H01R 13/635* (2006.01)
*H01R 13/633* (2006.01)
*H01R 13/04* (2006.01)

(52) U.S. Cl.
CPC ..... *H01R 13/6335* (2013.01); *H01R 13/04* (2013.01); *H01R 13/633* (2013.01); *H01R 13/635* (2013.01)

(58) Field of Classification Search
CPC ..... H01R 13/6335; H01R 13/635
USPC ..... 439/159, 160
See application file for complete search history.

(56) References Cited

U.S. PATENT DOCUMENTS 2,051,425 A * 8/1936 Schlums ..... H01R 13/631 439/159
2,134,345 A * 10/1938 Sheeran ..... H01R 13/633 439/159
2,430,011 A * 11/1947 Gillentine ..... H01R 13/633 254/122

(Continued)

FOREIGN PATENT DOCUMENTS

JP 06-086279 U 12/1994
JP 10-312855 A 11/1998

(Continued)

OTHER PUBLICATIONS

International Search Report dated Nov. 9, 2016, corresponding to International Publication No. PCT/KR2016/008136, citing the above reference(s).

(Continued)

*Primary Examiner* — Ross Gushi
(74) *Attorney, Agent, or Firm* — Hauptman Ham, LLP

(57) ABSTRACT

The present invention relates to an electric plug comprising: a body part including a reception part; a pin inserted in and fixed to one surface of the body part; and a detachment part included in the reception part, wherein the detachment part comprises a gear stick and a handle part rotating while being engaged with the gear stick. Therefore, the present invention enables a user to separate an electric plug tightly plugged in an outlet from the outlet even by tiny force.

3 Claims, 12 Drawing Sheets

(56) References Cited

U.S. PATENT DOCUMENTS 2,551,533 A * 5/1951 Gernheuser ..... H01R 13/633 174/66
2,571,046 A * 10/1951 Maisey ..... H01R 13/635 439/160
2,688,734 A * 9/1954 Welling ..... H01R 13/635 200/51 R
2,696,594 A * 12/1954 Harrington ..... H01R 13/633 439/160
3,475,715 A * 10/1969 Venaleck ..... H01R 13/635 439/159
3,737,835 A * 6/1973 Clement ..... H01R 13/635 439/155
4,326,763 A * 4/1982 Ristovski ..... H01R 13/635 439/108
5,679,014 A * 10/1997 Lan-Jen ..... H01R 13/6335 439/160
5,915,997 A * 6/1999 Lan-Jen ..... H01R 13/6335 439/694
5,964,605 A * 10/1999 Heydorn ..... H01R 13/633 439/157
6,062,883 A * 5/2000 Schreiber ..... H01R 13/633 439/159
6,095,849 A * 8/2000 Stekelenburg ..... H01R 13/6335 439/160
6,364,675 B1 * 4/2002 Brauer ..... H01R 13/635 439/159
6,540,533 B1 * 4/2003 Schreiber ..... H01R 13/633 439/159
6,716,044 B2 * 4/2004 Bertke ..... H01R 13/6335 439/159
6,913,475 B2 * 7/2005 Hsu ..... H01R 13/6335 439/160
7,125,258 B2 * 10/2006 Nakakubo ..... G06K 19/07741 439/328
7,344,393 B2 * 3/2008 Buller ..... H01R 13/635 439/152
7,628,626 B1 * 12/2009 Tseng ..... H01R 13/6335 439/160
8,083,531 B1 * 12/2011 Ourasanah ..... H01R 13/6335 439/159
8,553,419 B2 * 10/2013 Luo ..... G06K 13/0825 312/120
8,591,240 B2 * 11/2013 Jenks ..... G11B 17/00 439/159
8,767,381 B2 * 7/2014 Shukla ..... G06F 1/1658 361/679.01
8,770,996 B2 * 7/2014 Hsu ..... H01R 13/635 439/159
8,777,645 B2 * 7/2014 Cao ..... H01R 13/6275 439/159
8,814,582 B2 * 8/2014 Lee ..... G06K 13/0812 439/159
8,947,885 B2 * 2/2015 Wu ..... G06F 1/1613 361/679.31
9,164,539 B2 * 10/2015 Wu ..... G06F 1/1613
9,311,571 B2 * 4/2016 Lei ..... G06K 13/0831
9,350,833 B2 * 5/2016 Li ..... G06F 1/1613
9,379,487 B2 * 6/2016 Okoshi ..... H01R 13/633
9,405,334 B2 * 8/2016 Gong ..... G06F 1/183
9,414,510 B2 * 8/2016 Lei ..... H05K 5/0295
9,437,966 B2 * 9/2016 Gagne ..... H01R 13/62
9,461,411 B2 * 10/2016 Chuang ..... H01R 13/6581
9,529,391 B2 * 12/2016 Ely ..... G06F 1/1656
9,537,258 B2 * 1/2017 Bencuya ..... H01R 13/633
9,622,364 B2 * 4/2017 Baek ..... G06F 1/1613
9,625,944 B2 * 4/2017 Weber ..... G06F 1/163
9,627,797 B2 * 4/2017 Song ..... H01R 13/5213
9,658,641 B2 * 5/2017 Stephens ..... G06F 1/00
2002/0064983 A1 * 5/2002 Patey ..... H01R 13/7038 439/152
2003/0008539 A1 * 1/2003 Bertke ..... H01R 13/6335 439/160
2006/0030188 A1 * 2/2006 Pan ..... H01R 13/633 439/160
2006/0154506 A1 * 7/2006 Kikuchi ..... H01R 13/629 439/159
2011/0151695 A1 * 6/2011 Yang ..... H01R 12/7094 439/159
2011/0255252 A1 * 10/2011 Sloey ..... H04B 1/3816 361/752
2012/0162925 A1 * 6/2012 Luo ..... G06K 13/0831 361/727
2012/0195013 A1 * 8/2012 Trzaskos ..... G06K 13/0831 361/754
2013/0005167 A1 * 1/2013 Matsumoto ..... H01R 12/714 439/159
2013/0005168 A1 * 1/2013 Ye ..... G06K 13/08 439/159
2013/0286608 A1 * 10/2013 Liang ..... H05K 7/1402 361/754
2013/0309885 A1 * 11/2013 Liu ..... H01R 13/629 439/153
2013/0314854 A1 * 11/2013 Chung ..... H05K 5/0239 361/679.01
2013/0335896 A1 * 12/2013 Gao ..... H05K 7/1461 361/679.01
2014/0029206 A1 * 1/2014 Wittenberg ..... H05K 1/18 361/728
2014/0029211 A1 * 1/2014 Gao ..... G06K 13/0831 361/747
2014/0141642 A1 * 5/2014 Liao ..... G06K 13/0825 439/372
2014/0154926 A1 * 6/2014 Cao ..... G06K 7/04 439/634
2014/0185199 A1 * 7/2014 Chen ..... H05K 5/0295 361/679.01
2015/0099383 A1 * 4/2015 Takasaki ..... H05K 7/1409 439/159
2015/0155900 A1 * 6/2015 Myers ..... G06K 13/08 455/558
2015/0188257 A1 * 7/2015 Lin ..... G06K 13/0812 439/159
2015/0263455 A1 * 9/2015 Van der Steen ..... H01R 13/641 439/159
2015/0333444 A1 * 11/2015 Wang ..... H01R 13/633 439/159
2016/0036143 A1 * 2/2016 Motohashi ..... G06K 13/08 439/160
2016/0073540 A1 * 3/2016 Chang ..... H04B 1/3818 361/756
2016/0126997 A1 * 5/2016 Wu ..... G06K 13/08 455/575.1
2017/0162982 A1 * 6/2017 Wu ..... H01R 13/635
2017/0179659 A1 * 6/2017 Motohashi ..... H01R 12/721

FOREIGN PATENT DOCUMENTS

JP 11-031553 A 2/1999
KR 20-1999-0024286 U 7/1999
KR 10-0957676 B1 5/2010
KR 10-2011-0100490 A 9/2011

OTHER PUBLICATIONS

Korean Office Action dated Jan. 30, 2017 corresponding to Korean Application No. KR 10-2015-0108439, citing the above reference(s).

Korean Office Action dated Apr. 5, 2017 corresponding to Korean Application No. KR 10-2015-0108439, citing the above reference.

* cited by examiner

ELECTRIC PLUG

CROSS REFERENCE TO RELATED APPLICATION

This application is a continuation of International Application No. PCT/KR2016/008136, filed on Jul. 26, 2016, which claims priority to Korean Application No. 10-2015-0108439, filed Jul. 31, 2015. The entire disclosures of each of the above applications are incorporated herein by reference.

TECHNICAL FIELD

The present invention relates to an electric plug and, more particularly, to an electric plug, which can be easily disconnected from an outlet.

BACKGROUND ART

Generally, an electric plug is provided to the end of a cord, which is connected to an electric appliance, as a kind of electric wiring mechanism and serves as a connection mechanism to be used to be plugged into an outlet. In general, electricity coming into a home or a factory is connected to an outlet, and the plug of an electric appliance is plugged into the outlet so as to supply electric power to the electric appliance. Herein, the plug has two pins (electrical connecting rods) fixed to a connection part for the outlet, for example, a plug body part and connected to a cord, such that the pins are inserted and fixed into the holes of the outlet to supply electric power to the electric appliance. Meanwhile, In the case of an electrical appliance, of which plug is repeatedly plugged in a home outlet, such as home appliances, the plug must be easily removable from the outlet.

However, it is considerably inconvenient to remove a plug that is strongly plugged into an outlet and, furthermore, the plug can be easily separated with strong force (generally 15 kgf for adults) to hold and pull the plug body part by hand. Herein, human plug-gripping force is less than plug-pulling force. When pulling a plug, it is necessary to use stronger pulling force than the plug-gripping force. Therefore, it is not easy to pull out a plug that is tightly plugged into an outlet for women, children and elderly people with weak hand force.

Therefore, in order to disconnect such a plug, which is strongly plugged into an outlet, people usually hold the outlet with one hand and hold the plug with the other hand and then pull out the plug, or people pull out a plug cord. Therefore, it is likely to break the outlet or the plug, or the electrical connection thereof.

Meanwhile, In order to solve these problems, there has been suggested a product designed to attach a ring-shaped handle to the plug such that the plug can be easily pulled out by pulling the ring-shaped handle. FIG. 1 is a view for illustrating a prior art electric plug having such a ring part. However, the prior art electric plug still has inconvenience that, when pulling out the plug having a ring part, people have to pull the plug while holding the outlet with one hand. In addition, the ring part is likely to be broken in use. Therefore, fundamental problems still remains unsolved, and it is necessary to develop an electric plug which can easily be detached from an outlet with small force.

DISCLOSURE

Technical Problem

Accordingly, the present invention has been made in an effort to solve the above-mentioned problems occurring in the prior arts, and it is an object of the present invention to provide an electric plug that is easy to be separated from an outlet with small force, thereby ensuring convenience in use.

The objects of the present invention are not limited to the above-mentioned object, and other objects not mentioned may be clearly understood by those skilled in the art from the following description.

Technical Solution

In order to solve the above-mentioned problems, the present invention provides an electric plug, including a body part having a reception part, pins inserted and fixed in one surface of the body part, and a detachment part provided to the reception part, wherein the detachment part includes a gear stick and a handle part rotating while being engaged with the gear stick.

In addition, the present invention provides the electric plug, in which the reception part includes a penetration part penetrating the body part, and the penetration part includes an upper opening part at one side of the body part and a lower opening part at the other side of the body part, such that a part of the handle part is exposed through the upper opening part and a part of the gear stick is exposed through the lower opening part.

Besides, the present invention provides the electric plug, in which the handle part includes: a serrated part engaged with the gear stick so as to rotate; a rotation shaft provided to the serrated part; and a press part extended from one side of the serrated part, wherein the handle part is individually provided at both sides of the gear stick with respect to the center of the gear stick.

Furthermore, the present invention provides the electric plug, in which the gear stick includes: a gear shaft; a gear part formed on a portion of the outer circumferential surface of the gear shaft and engaged with the serrated part; and a support part formed on the outer circumferential surface of the gear shaft, wherein the gear part has a plurality of gear protrusions formed to be perpendicular to the lengthwise direction of the gear shaft and provided at a uniform interval along the lengthwise direction of the gear shaft.

In addition, the present invention provides the electric plug, in which the gear shaft and the serrated part rotation shaft are provided to be orthogonal to each other, and support pins are inserted into the serrated part rotation shaft so as to be fixed in the body part.

Besides, the present invention provides the electric plug, in which the press part further includes a display part formed at one end part thereof so as to identify a coupling state with respect to an outlet.

Advantageous Effects

As described hereinabove, according to the present invention, the plug can be disconnected from an outlet using only one hand, and is thus convenient to use.

In addition, according to the present invention, the electric plug can be separated with small force and thus it is less likely to leave the plug in the outlet, thereby reducing power consumption.

MODE FOR INVENTION

Hereinafter, preferred embodiments of the present invention will be described in detail with reference to the accompanying drawings.

Figure 1:
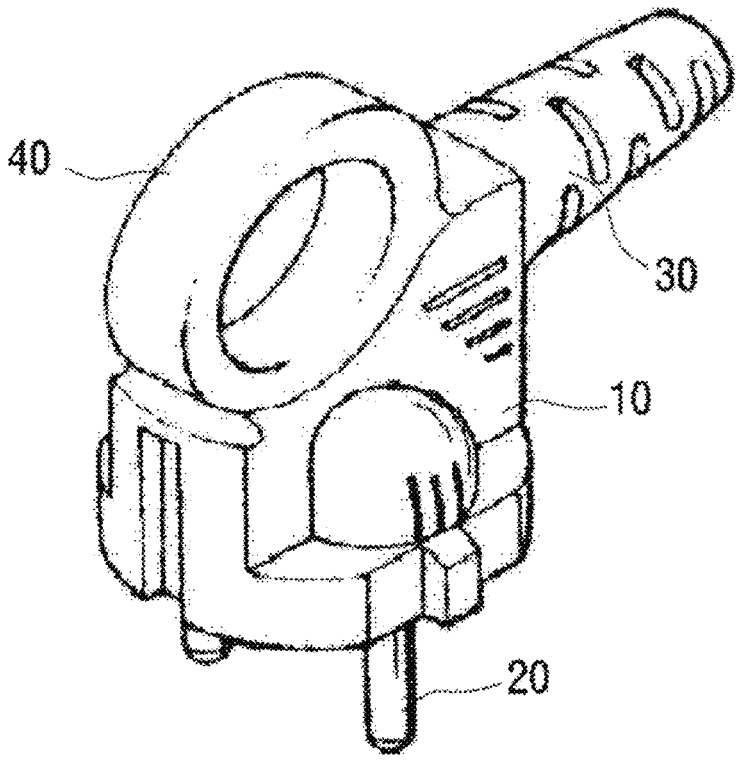
FIG. 1 is a view for illustrating a prior art electric plug.

First, FIG. 1 shows a prior art electric plug. In general, an electric device is connected to a cord with a plug for supplying electricity, wherein the plug is plugged into an outlet to supply electricity. It is not so difficult to put the plug into an outlet, but when the pins of the plug are firmly plugged into the outlet, it is difficult to pull out the plug.

Particularly, the plug, which is firmly plugged into an outlet, has to be separated only by the pulling force of a hand. Therefore, it is difficult to pull out the plug in case of women, children and elderly people with weak grip. In order to disconnect such a plug, which is firmly plugged into an outlet, people usually hold the outlet with one hand and hold the plug with the other hand, and then shake the plug up and down with the both hands. Also, people pull out the plug cord during the detachment process. Therefore, a failure such as the break of the electrical connection of the plug and the like may occur.

Therefore, in order to solve the inconvenience, there has been suggested an electric plug with a ring part 40, as shown in FIG. 1. Such a plug includes a body part 10, pins 20 provided for the electrical connection with respect to an outlet, a connection part 30 connected to a cord, and the like. However, if the plug is disconnected by pulling the ring part 40, there is still the inconvenience of holding the outlet with one hand and pulling the plug body part with the other hand even though there is no failure in the code line itself. Furthermore, since a user has to put his finger in the ring part 40 and pull the ring part 40 with that finger, it can be hard on the user. Besides, due to the structural features of the ring part 40, there is a concern that if the user plugs and unplugs the plug from time to time, the ring part might have been broken.

Therefore, according to preferred embodiments of the present invention, there is provided an electric plug, which can be detached even when only one hand is used and can be easily separated from the outlet even with small force.

Figure 2:
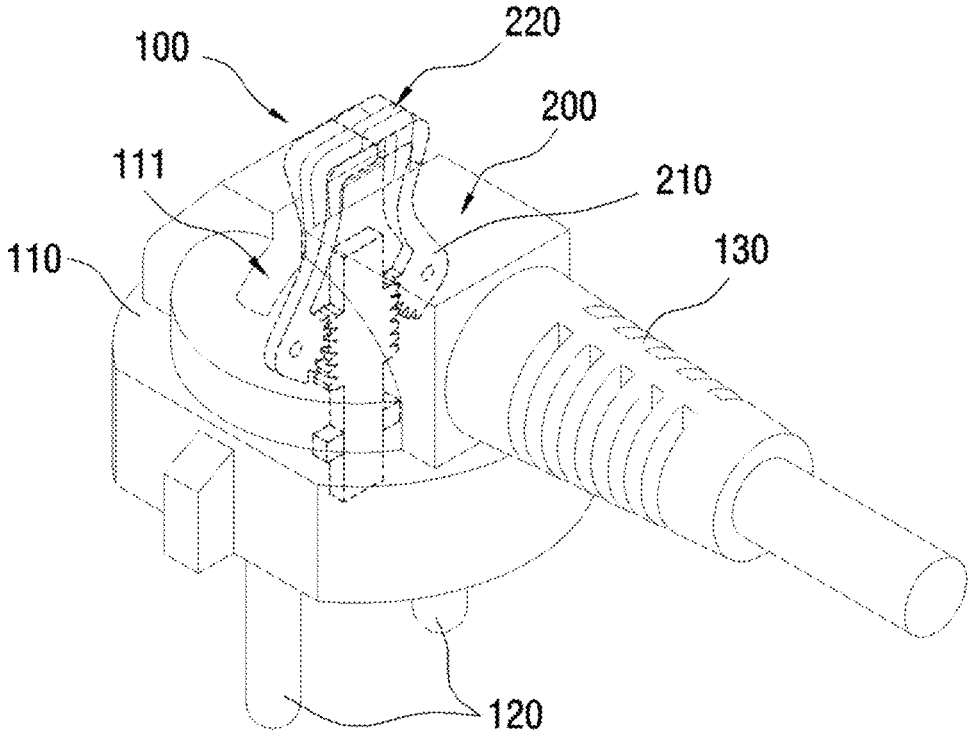
FIG. 2 is a perspective view for showing an electric plug according to an embodiment of the present invention.
Figure 3:
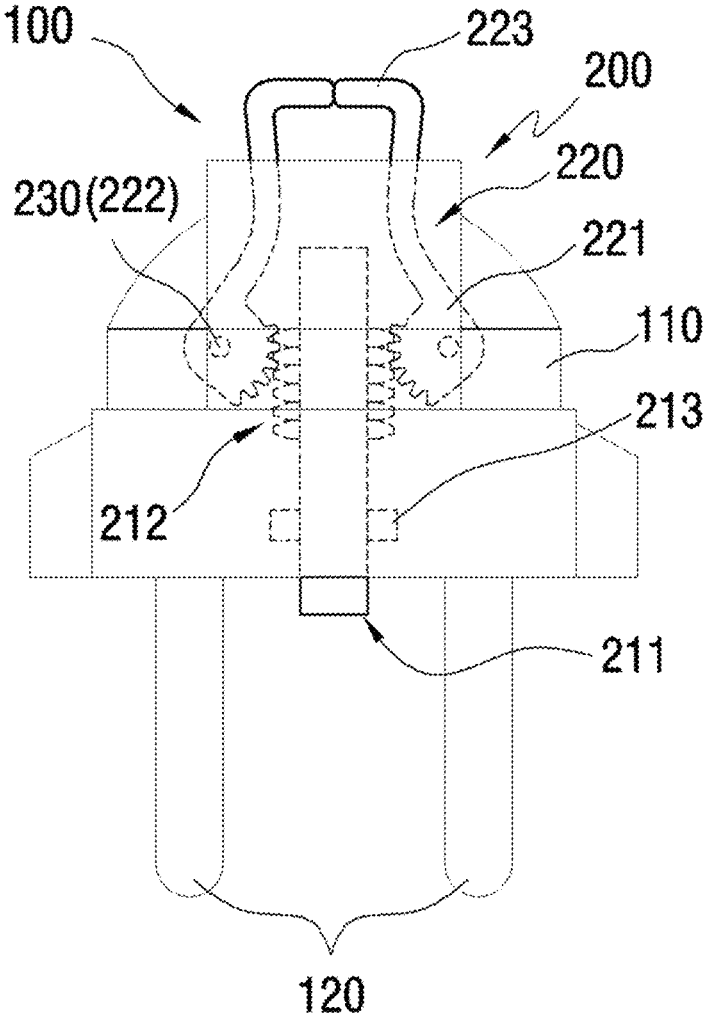
FIG. 3 is a front view for showing an electric plug according to an embodiment of the present invention.
Figure 4:
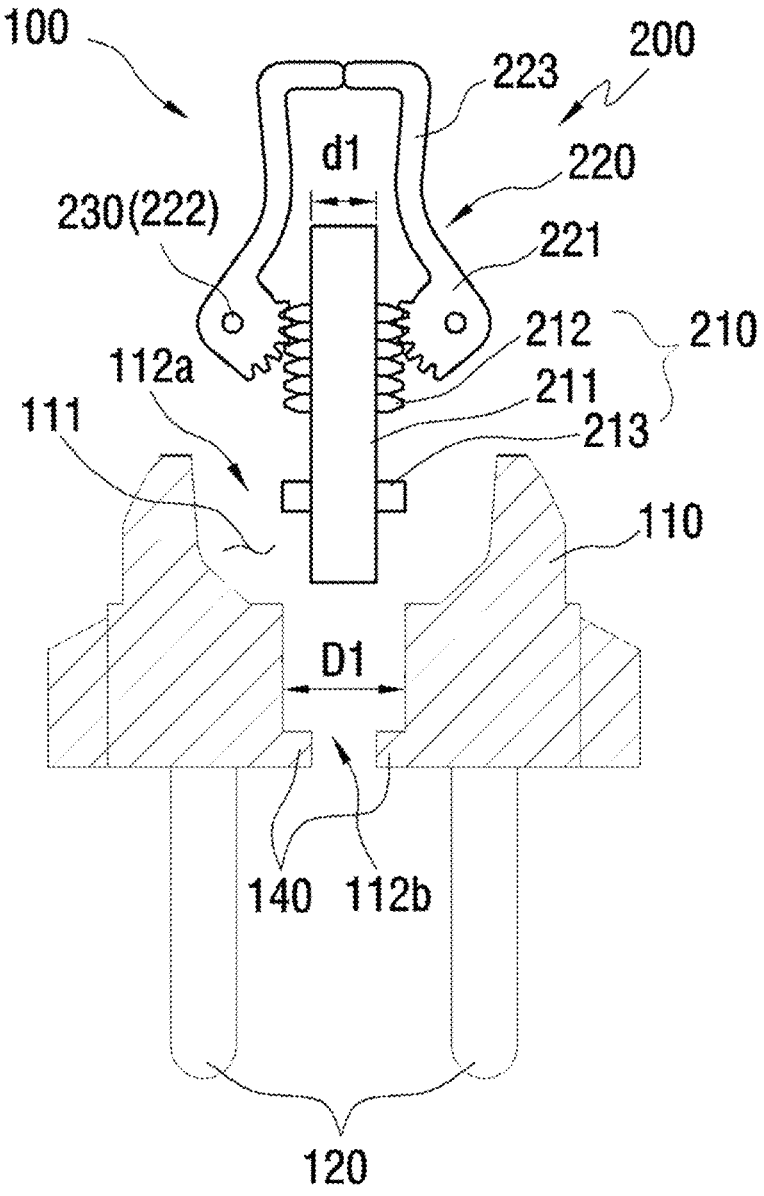
FIG. 4 is an exploded view for showing an electric plug according to an embodiment of the present invention.

FIG. 2 is a perspective view of an electric plug according to an embodiment of the present invention, FIG. 3 is a front view of the electric plug and FIG. 4 is an exploded view of FIG. 3. As shown in FIG. 2 to FIG. 4, an electric plug 100, according to an embodiment of the present invention, includes a body part 110, pins 120 inserted into one surface of the body part so as to be fixed therein, and a detachment part 200 provided to the body part. Furthermore, the body part 110 includes a connection part 130 provided at one side thereof for the connection of a cord line, and the body part 110 includes a reception part 111 for receiving the detachment part 200.

Besides, the reception part 111 is formed with a penetration part 112 formed penetrating the body part 110 so as to communicate with the reception part 111. As shown in FIG. 4, the penetration part 112 includes an upper opening part 112*a* penetrating the upper portion of the body part 110 in the reception part 111 and a lower opening part 112*b* penetrating the lower portion of the body part in the reception part 111, wherein the upper opening part 112*a* and the lower opening part 112*b* are connected to each other and the lower opening part 112*b* is formed in one surface of the body part 110, into which the pins 120 is inserted and fixed, that is, the lower surface of the plug body part 110.

The detachment part 200, which is provided to the reception part 111, is provided in a state, in which a part of the upper portion of the detachment part 200 is provided to be protruded upwards through the penetration part 112*a* and a part of the lower portion of the detachment part 200 is assembled to be protruded downwards through the lower opening part 112*b*.

Figure 5:
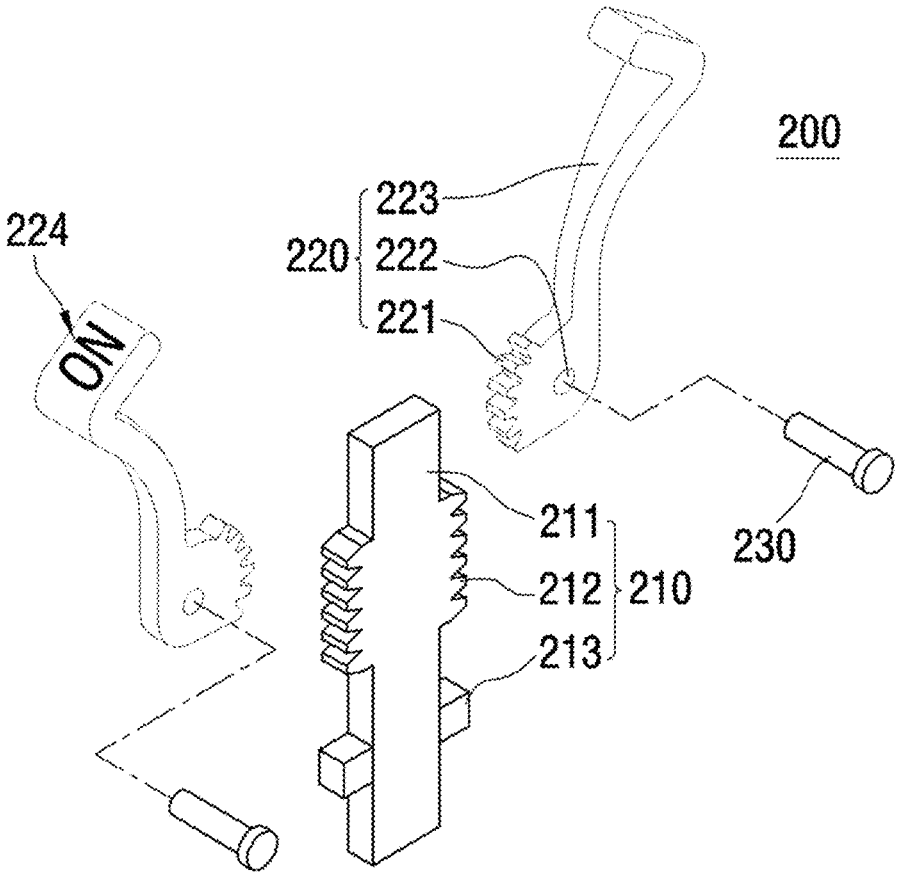
FIG. 5 is an exploded view for showing a detachment part of an electric plug according to an embodiment of the present invention.
Figure 6:
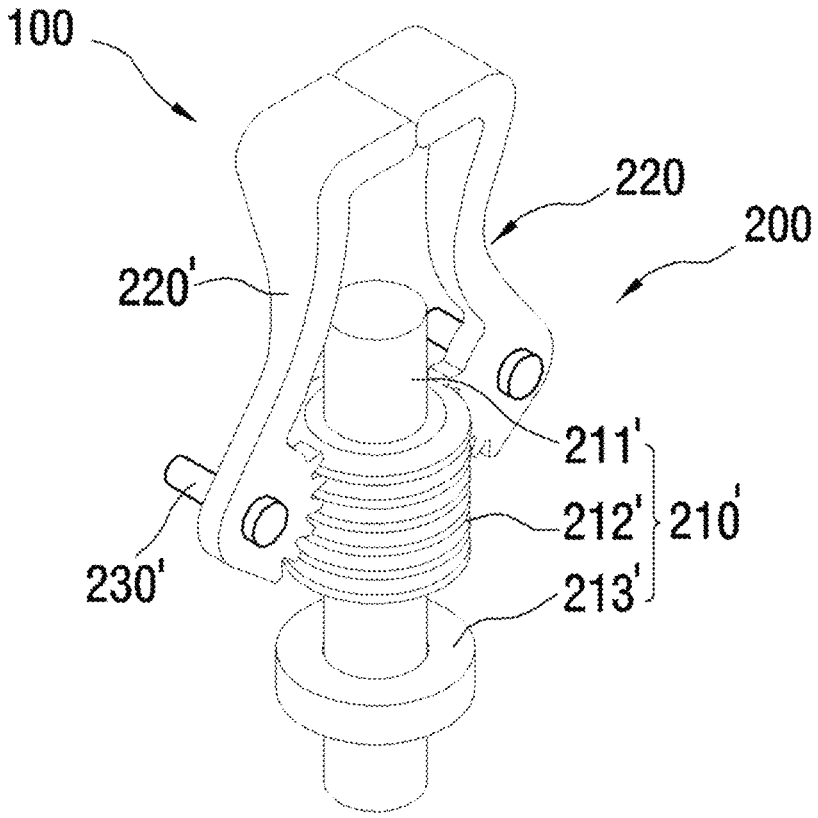
FIG. 6 is a view for showing a detachment part of an electric plug according to an embodiment of the present invention.

FIG. 5 is an exploded view for showing a detachment part for an electric plug according to an embodiment of the present invention, and FIG. 6 is a perspective view for showing the detachment part, which is assembled. The detachment part 200 includes a gear stick 210 having a gear part 212 formed on the outer circumferential surface thereof, and one pair of handle parts 220 for rotating in engagement with the gear stick 210.

The gear stick 210 includes a gear shaft 211 in a linear shape, a gear part 212 formed on a portion of the outer circumferential surface of the gear shaft 211, and a support part 213 formed on the outer circumferential surface of the gear shaft 211 at the lower portion of the gear part 212.

In addition, each of the handle parts 220 includes a serrated part 221 for rotating in engagement with the gear part 212, and a press part 223 extended outwards in the upward direction from the serrated part 221, wherein the handle part 220 is supported so as to rotate with respect to a support pin 230, which is inserted into a support hole 222. The support pin 230 is inserted into the support hole 222, and the support pin 230 acts as a rotation shaft for the rotation of the serrated part 221, thereby supporting the handle part 220 in the plug body part 110 so as not to escape therefrom.

In addition, the gear shaft 211 of the gear stick 210 is provided in a vertical state and the support pin 230 of the serrated part 221 is provided in a horizontal state. The gear part 212 is formed on a part of the outer circumferential surface of the gear shaft and engaged with the serrated part 221 of the handle part 220. Therefore, in a state, in which the gear part 212 is engaged with the serrated part 221, the gear part 212 is interlocked with the serrated part 221 and moves together with the serrated part 221 according to the movement of the serrated part 221, wherein the rotational motion of the handle part 200 can be converted into the linear motion of the gear stick 210.

That is, if the serrated part 221 carries out rotational motion with respect to the support pin 230, power is transmitted through the gear part 212, which is engaged with the serrated part 221 such that the gear shaft 211 carries out linear motion in the vertical direction. In addition, it is preferable that the handle part 220 includes one pair of handle parts symmetrically arranged in the right and left directions as shown in the drawings.

Meanwhile, as mentioned hereinabove, the upper portion of the detachment part 220 is provided in the upper opening part 112*a* in a state, in which the upper portion of the detachment part 220 is exposed upwards from the body part 110, and the lower portion of the detachment part 220 is protruded to the outside of the body part 110 through the lower opening part 112*b* or re-inserted into the body part 110. That is, the upper end portion of the press part 223 of the handle part 220, which forms the upper portion of the detachment part 200, is in the state of being protruded from the plug body part 110 and exposed upwards. Therefore, a user can easily pull out the plug, which is inserted into an outlet, by manipulating the exposed press part 223 by hand.

In addition, the lower end portion of the gear shaft 211, which forms the lower portion of the detachment part 200, is protruded downwards from the body part 110 through the lower opening part 112*b*. When plugging the plug into an outlet, the lower end of the gear shaft 211 is inserted to the inside of the lower opening part 112*b*. To the contrary, when unplugging the plug from an outlet, the one end of the gear shaft 211 is protruded to the outside of the lower opening part 112*b*, wherein the operation principle will be described hereinafter with reference to FIG. 7 and FIG. 8.

According to the embodiment of the present invention, the gear stick 210 carries out linear motion in the vertical direction in the lower opening part 112*b* in a state, in which the gear stick 210 is inserted in the reception part 111. Therefore, it is preferable that the shape of the cross-section of the gear stick 210 is formed of a shape and a diameter, which are similar to those of the cross-section of the lower opening part 112*b*.

Besides, according to the embodiment of the present invention as shown in FIG. 5, even though the gear stick 210 and the lower opening part 112*b* are shown having a rectangular sectional shape, in the present invention, the sectional shapes of the gear stick and the lower opening part are not limited to such a rectangular shape but the gear stick and the lower opening part may, of course, be provided in a circular or polygonal structure as shown in the embodiment of FIG. 6.

In addition, in order to enable a part of the lower end of the gear shaft 211 of the gear stick 210 to be inserted to the inside of the lower opening part 112*b* and carry out the linear motion in the axial (vertical) direction, the cross section of the gear shaft has to be smaller than the cross section of the lower opening part 112*b*. Herein, since the gear part 212, which is protruded outwards from the gear shaft 211, is formed on the outer circumferential surface of the gear shaft 211 and the lower end portion of the gear part 212 is inserted to the inside of the lower opening part 112*b*, for example, a width d1 of the gear shaft 211 is formed to be smaller than a width D1 of the lower opening part 112*b*.

Since the gear shaft 211 may shake or be misaligned within the lower opening part 112*b*, the support part 213 may be further provided on the outer circumferential surface of the gear shaft 211 in the present invention.

The support parts 213 are formed to be extended outwards at both sides of the gear shaft 211 so as to slide in contact with the inner circumferential surface of the lower opening part 112*b* at the side surfaces thereof when the vertical movement of the gear shaft 211. Therefore, the support parts 213 serve to support the gear shaft 211 in the lower opening part 112*b* such that the gear shaft 211 can move accurately in the axial (vertical) direction without shaking in the lower opening part 112*b*.

In addition, a holding protrusion 140 may be formed on the inside of the lower opening part 112*b*, where the support part 213 slides. This holding protrusion 140 is to limit the lower end movement of the gear shaft 211. That is, as described hereinabove, when the lower end portion of the gear shaft 211 moves in the vertical direction while sliding in the lower opening part 112*b*, the end portion of the gear shaft 211 is protruded out of the end portion of the lower opening part 112*b* or inserted into the lower opening part 112*b*. With respect to the movement of the gear shaft 211, the holding protrusion 140 is held on the top surface of the support part 213, which is formed on the gear shaft 211, and thus serves to support the gear shaft 211 such that the gear shaft 211 does not move to the outside of the lower opening part 112*b* any more.

Meanwhile, even though the support part 213 may be provided in the shape of a holding protrusion as mentioned above in the case where the gear stick has a rectangular sectional shape as in the above-mentioned embodiment, it is also possible to provide a ring-shaped support part 213' as shown in the embodiment of FIG. 6.

According to the embodiment of the present invention, as shown in FIG. 6, it can be noted that the sectional shape of a gear stick 210' may be formed in a rectangular shape, and thus the shape of a gear part 212' and a support part 213' may also be formed in a ring shape along the periphery of the gear stick 210'. In this case, of course, even though not illustrated, the penetration part 112 of the plug body part may also have a circular sectional shape, corresponding to the shape of the gear stick 210'.

Figure 7:
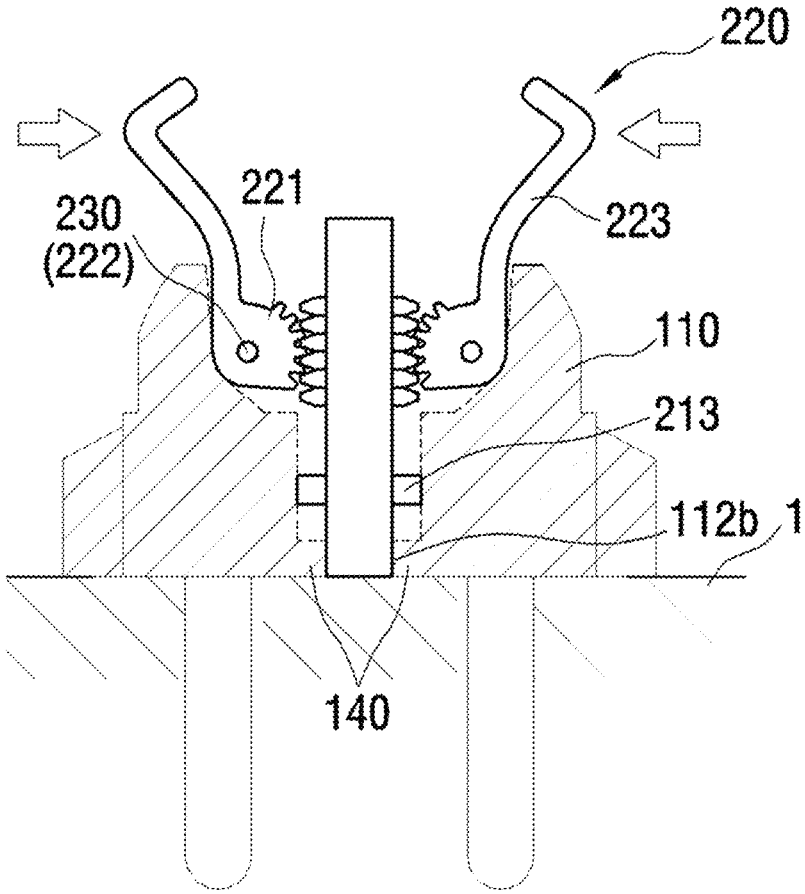
FIG. 7 and FIG. 8 are views for showing the use states of an electric plug according to an embodiment of the present invention, in which the process for separating the electric plug from an outlet is illustrated.
Figure 8:
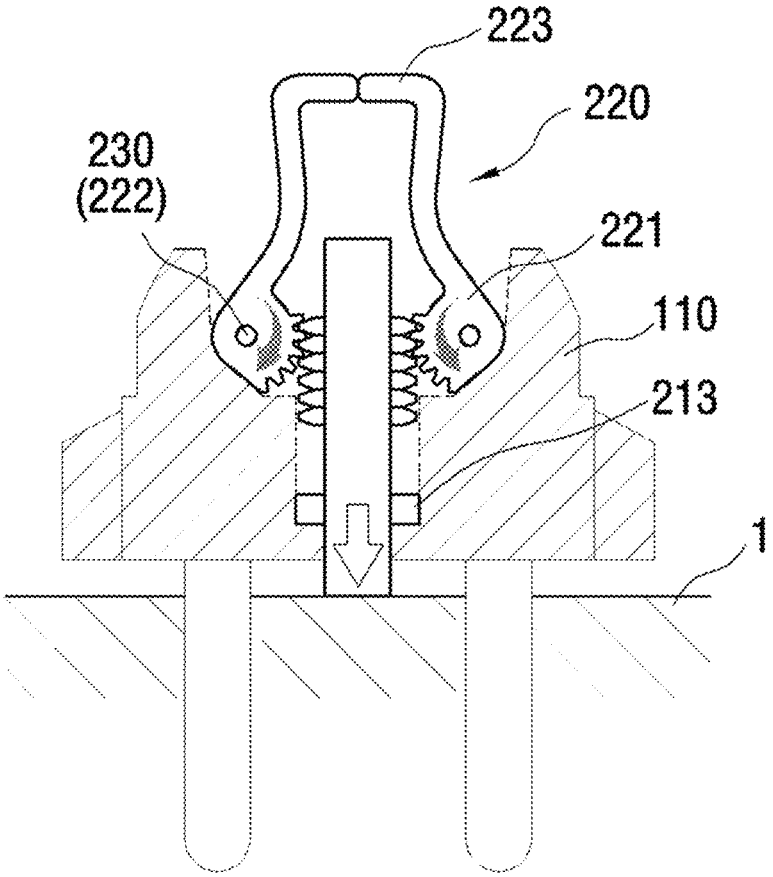

Next, the handling of the electric plug according to an embodiment of the present invention will be described hereinafter. FIG. 7 and FIG. 8 are views for showing the use states of an electric plug according to an embodiment of the present invention, in which FIG. 7 shows a state, in which the electric plug is plugged in an outlet, and FIG. 8 shows a state, in which the electric plug is separated from the outlet.

In order to separate the plug from an outlet 1, the electric plug plugged into the outlet can be pulled out by manipulating the one pair of handle parts 220, which are provided at both sides of the gear stick 210 and protruded upwards outside of the plug body part 110. As shown in FIG. 7, in a state, in which the plug is plugged in the outlet 1, the lower end portion of the gear shaft 211 of the gear stick 210 is in an inserted state in the lower opening part 112*b*.

In order separate the plug from the outlet in the above state, the press parts 223 of the one pair of handle parts 220 are pressed from the outside to the inside by hands. For example, if the one pair of press parts 223 of the handle parts 220 are held and pressed by the thumb and the index finger, then the upper end portions of the one pair of press parts 223 come close to each other and thus the serrated parts 221, which are formed at the lower portions of the press parts 223 rotate with respect to the support pins 230.

In addition, considering the rotation directions of the one pair of serrated parts 221, as shown in FIG. 8, when viewed from the front surface of the plug, the left serrated part with respect to the gear shaft 211 rotates in the clockwise CW direction and the right serrated part rotates in the counterclockwise CCW direction. Therefore, as the one pair of serrated parts 221 rotate, the gear part 212, which is engaged with the serrated parts 221, carries out linear motion in the downward direction in association with the serrated parts 221.

Therefore, the gear stick 210 moves in the downward direction in the lower opening part 112*b* provided in the plug body part 110 and thus the lower end portion of the gear shaft 211 of the gear stick 210 is protruded to the outside of the lower opening part 112*b*. Therefore, the lower end portion of the gear shaft 211, which is protruded out of the bottom surface portion of the plug body part 110, pushes the top surface of the outlet 1, which is in contact with the plug, such that the plug pins 120 are released from the outlet.

When pulling out the plug as mentioned above, the support part 213 provided to the outside of the gear shaft 211 is held on the holding protrusion 140 provided to the inside of the lower end portion of the lower opening part 112*b*, thereby stopping the downward movement of the gear shaft 211. Furthermore, a display part 224 for the identification of a coupling state with respect to an outlet may be further provided at the upper end of the press part 223, which is protruded upwards outside of the plug body part 110. The display part 224 is to an element provided with appropriate characters or symbols such that a user can visually recognize the states of the handle parts 220.

Figure 9:
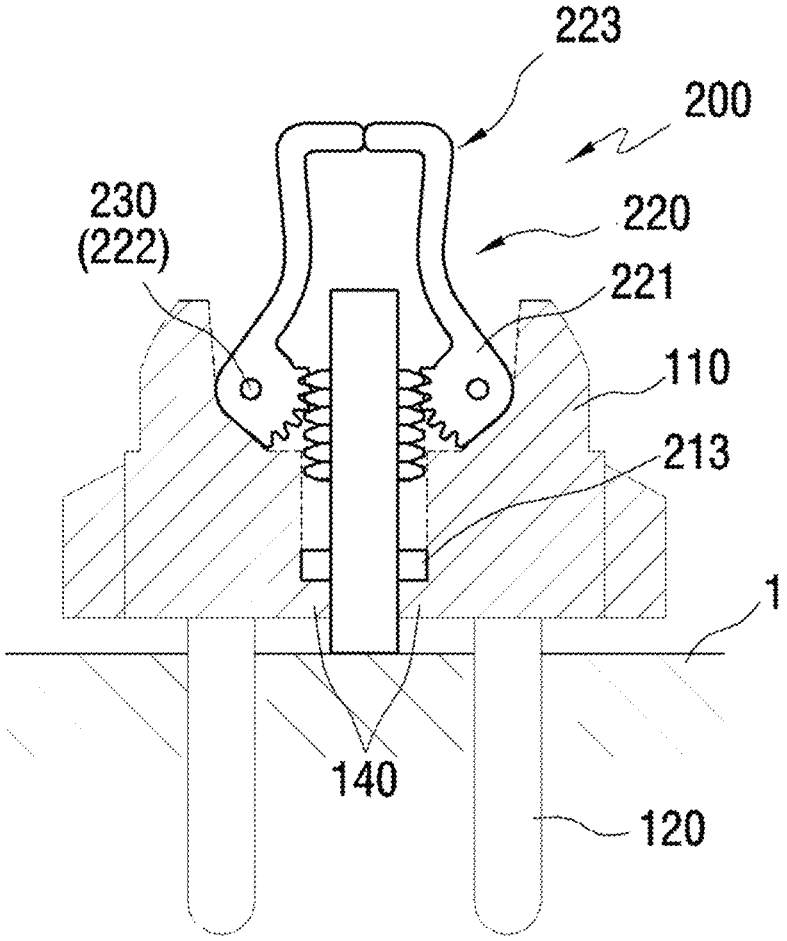
FIG. 9 and FIG. 10 are views for showing the use states of an electric plug according to an embodiment of the present invention, in which the process for coupling the electric plug to an outlet is illustrated.

Next, a process of plugging the electric plug of the present invention into an outlet will be described. First, as shown in FIG. 9, in a state, in which the electric plug 100 has been disconnected from the outlet 1, the one pair of press parts 223 at the upper ends of the handle parts 220 are in a closed state and the lower end portion of the gear shaft 211 of the gear stick 210 is in the state of being protruded downwards out of the lower opening part 112*b* and exposed below the plug body part 110.

Figure 10:
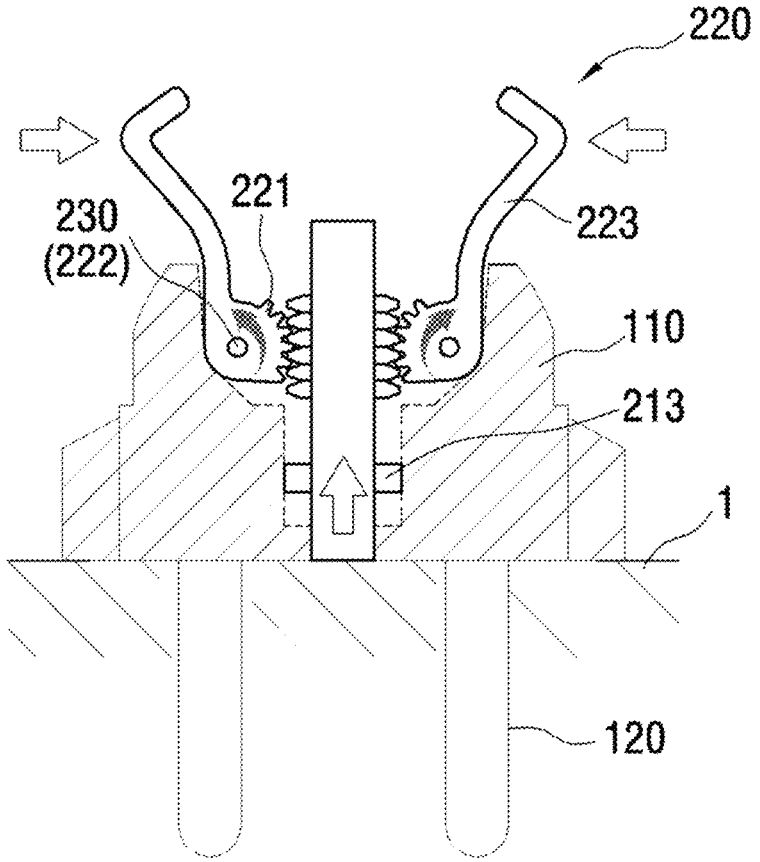

In addition, if a user connects the plug into the outlet 1 by holding the plug body part 110, as shown in FIG. 10, then the top surface of the outlet 1, which comes into contact with the plug, pushes the protruded lower end of the gear shaft 211 in the upward direction and the plug pins 120 are inserted into the outlet 1, such that the plug is plugged into the outlet 1. As described hereinabove, the plug is used in a state, in which the plug body part 110 is coupled in the outlet, and the operation of the detachment part 200 when the plug is separated from the outlet is the same as mentioned above.

Figure 11:
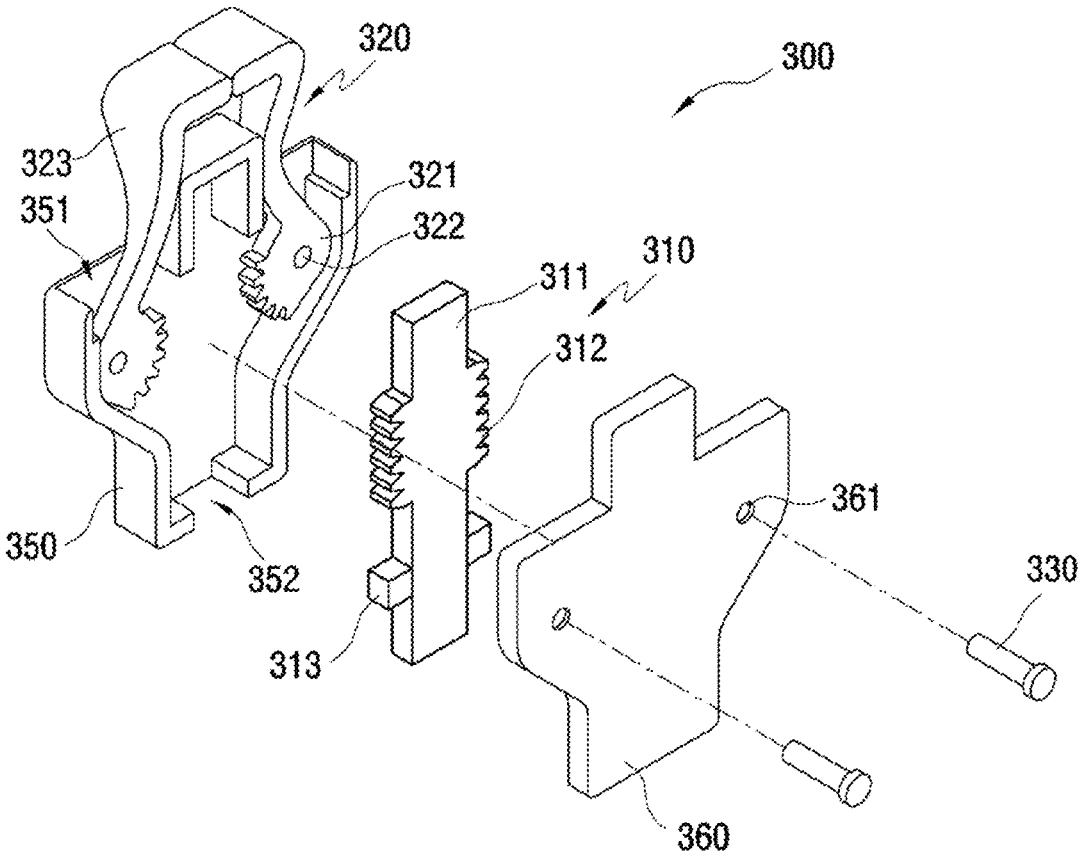
FIG. 11 is a view for illustrating an assembly type detachment part for an electric plug according to an embodiment of the present invention.
Figure 12:
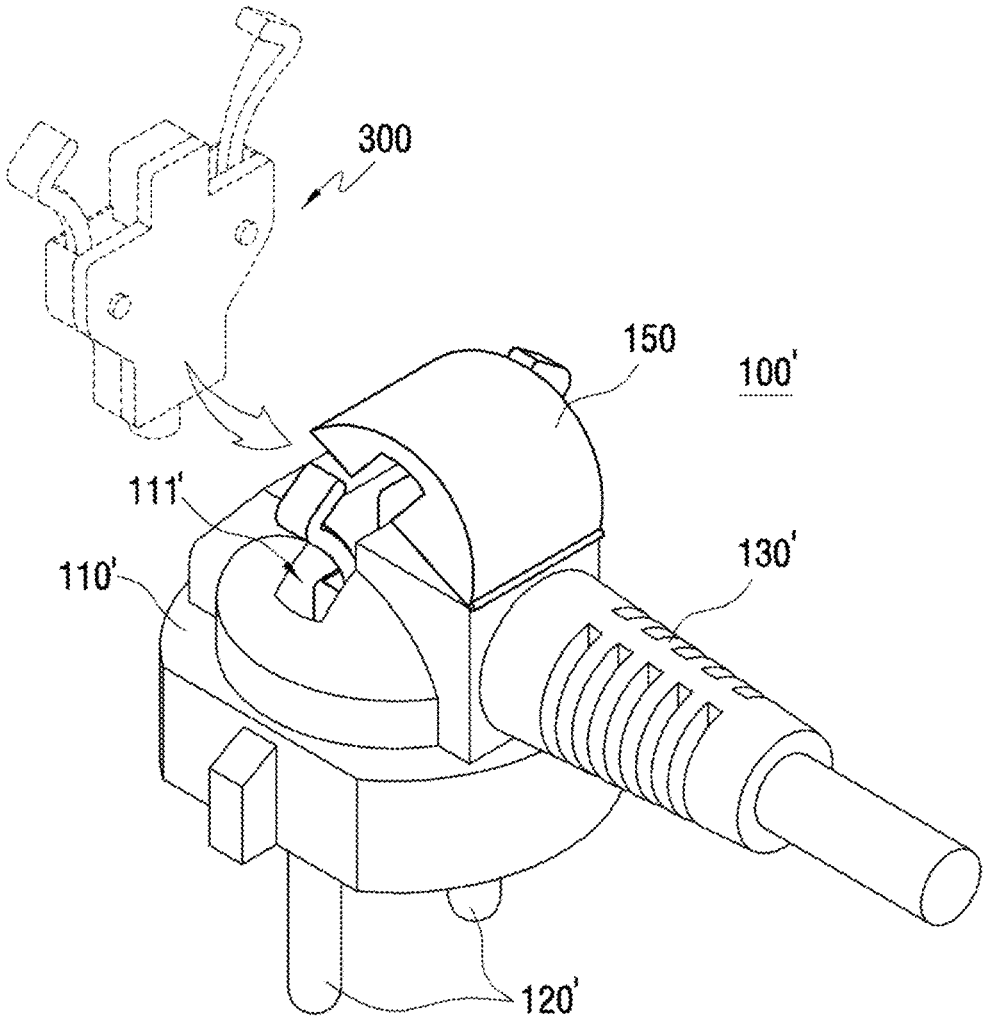
FIG. 12 is a view for illustrating an electric plug, to which an assembly type detachment part is applied according to an embodiment of the present invention.

FIG. 11 is a view for illustrating an assembly type detachment part 300 according to another embodiment of the present invention, and FIG. 12 is a view for illustrating an electric plug, to which an assembly type detachment part of FIG. 11. An electric plug 100' according to this embodiment of the present invention can be formed by carrying out injection molding such that a reception part 111' for the insertion of the assembly type detachment part 300 is included in a plug body part 110', and then inserting the assembly type detachment part 300 into the reception part 111'.

The assembly type detachment part 300 can be said to be substantially the same as the detachment parts in the above-mentioned embodiments of the present invention and may further include a housing 350, which is inserted to the inside of the electric plug 100', and a cover 360. The gear stick 310 and the handle parts 320 are assembled into the housing 350. Furthermore, the housing 350 may include a first opening part 351 provided at the upper portion thereof for the manipulation of the press parts 323 of the handle parts 320 and a second opening part 352 provided at the lower portion thereof for the protrusion of the lower end portion of the gear shaft 311 of the gear stick. The other constituent elements in this embodiment are the same as those of the detachment part 200 as mentioned above, and thus detailed description thereof will be omitted.

As shown in FIG. 12, the plug body part 110' includes the reception part 111' for receiving the assembly type detachment part 300 including the housing 350 and the cover 360 as mentioned above. Furthermore, for the operation of the detachment part 300 assembled in the reception part 111', the plug body part 110' has to include opening parts provided at the upper part portion and the lower portion thereof. The body part 110' may further include a cap 150 provided at the upper portion thereof so as to protect the detachment part. For example, as shown in FIG. 12, the assembly type detachment part 300 can be inserted to the inside of the reception part 111' by opening the cap 150, which is hinge-coupled to the upper portion of the body part 110'. Herein, the lower end portion of the gear shaft 311 of the assembly type detachment part can be protruded through the opening part which is formed at the lower portion of the body part 110'.

As described above, while the present invention has been particularly shown and described with reference to the embodiments thereof, it will be understood by those of ordinary skill in the art that the above embodiments of the present invention are all exemplified and various modifications and improvements may be made therein without changing the essential characteristics and technical idea of the present invention. Therefore, it should be understood that the above described embodiments are illustrative in all aspects and not restrictive.

The invention claimed is:

1. An electric plug, comprising:

a body part including a reception part, which is formed to be concave, an upper opening part communicating with the reception part and having a top surface portion, which is opened, a lower opening part communicating with the reception part and having a bottom surface portion, which is opened, and one pair of pins for electric connection, which are extended downwards from the bottom surface of the body part;

a gear stick having a gear part formed at the center portion thereof, and provided to be movable in the vertical direction in the reception part so as to be exposed out of the lower portion of the body part through the lower opening part; and one pair of handle parts provided in the reception part, having serrated parts engaged with the gear part, supported so as to rotate with respect to a support pin arranged at both side surfaces of the gear stick, and exposed out of the upper portion of the body part through the upper opening part at the upper portions thereof;

wherein, if the handle parts are rotated such that the upper end portions of the handle parts, which are exposed out of the upper portion of the body part, are close to each other, the gear stick moves downwards through the gear part, which is engaged with the serrated parts, and the lower end portion of the gear stick presses the top surface of an outlet, thereby acting as force which allows the plug to be detached from the outlet.

2. The electric plug according to claim 1, wherein the gear stick has support parts extended outwards from the center portion of the gear stick such that the gear stick can slide on the inner surface of the lower opening part in a state, in which the outer ends of the support parts are in contact with the inner surface of the lower opening part.

3. The electric plug according to claim 2, wherein the lower opening part has holding protrusions formed on the inside thereof so as to hold the support parts, thereby limiting the downward movement of the gear shaft.

* * * * *